US009310104B2

(12) United States Patent
Diederichs et al.

(10) Patent No.: US 9,310,104 B2
(45) Date of Patent: Apr. 12, 2016

(54) MODULAR ARCHITECTURE FOR HELIUM COMPRESSORS

(71) Applicants: Jost Diederichs, San Diego, CA (US); Michael Bancroft Simmonds, Bozeman, MT (US)

(72) Inventors: Jost Diederichs, San Diego, CA (US); Michael Bancroft Simmonds, Bozeman, MT (US)

(73) Assignee: Quantum Design International, Inc., San Diego, CA (US)

( * ) Notice: Subject to any disclaimer, the term of this patent is extended or adjusted under 35 U.S.C. 154(b) by 168 days.

(21) Appl. No.: 13/961,884

(22) Filed: Aug. 7, 2013

(65) Prior Publication Data

US 2013/0319037 A1 Dec. 5, 2013

Related U.S. Application Data

(63) Continuation-in-part of application No. 13/763,619, filed on Feb. 8, 2013, now abandoned.

(60) Provisional application No. 61/596,724, filed on Feb. 8, 2012.

(51) Int. Cl.
*F25B 1/00* (2006.01)

(52) U.S. Cl.
CPC ..... *F25B 1/00* (2013.01)

(58) Field of Classification Search
CPC ..... F25B 1/00
USPC ..... 62/468, 507; 184/6.17
See application file for complete search history.

(56) References Cited

U.S. PATENT DOCUMENTS

| | | | | |
|---|---|---|---|---|
| 4,754,606 | A * | 7/1988 | Nam | 60/616 |
| 5,027,606 | A | 7/1991 | Short | |
| 6,488,120 | B1 * | 12/2002 | Longsworth | F04B 39/04 184/6.16 |
| 2004/0129015 | A1 * | 7/2004 | Apparao et al. | 62/335 |
| 2011/0107790 | A1 * | 5/2011 | Dunn | F04B 39/06 62/507 |

FOREIGN PATENT DOCUMENTS

| | | | | |
|---|---|---|---|---|
| JP | 55054684 | * | 4/1980 | F04B 39/06 |
| RU | 2442005 | | 10/2012 | |
| SU | 909485 | | 2/1982 | |

OTHER PUBLICATIONS

ISR and Written Opinion for PCT/US2013/070454 (6 pages). Issued May 7, 2014.

* cited by examiner

*Primary Examiner* — Emmanuel Duke
(74) *Attorney, Agent, or Firm* — Stetina Brunda Garred & Brucker

(57) ABSTRACT

A modular architecture for helium compressors is described. In the modular architecture, oil is cooled independently from gas. In one aspect, the oil is cooled subsequent to the gas with a series of water-cooled heat exchangers. In another aspect, the oil is cooled using a water-cooled heat exchanger coupled to a radiator, and the gas is independently cooled using a refrigerant-cooled heat exchanger coupled to a condensing unit.

5 Claims, 4 Drawing Sheets

MODULAR ARCHITECTURE FOR HELIUM COMPRESSORS

CROSS-REFERENCE TO RELATED APPLICATIONS

This application is a continuation in part of U.S. Ser. No. 13/763,619, filed Feb. 8, 2013;

which claims benefit of priority to U.S. Provisional Ser. No. 61/596,724, filed Feb. 8, 2012.

BACKGROUND OF THE INVENTION

1. Field of the Invention

This invention relates to cryogenic refrigeration systems; and more particularly, to a modular architecture for helium compressors within such cryogenic refrigeration systems.

2. Description of the Related Art

In conventional systems, about 10% of heat generated by a helium compressor is transferred into the helium, but this helium should be cooled to less than 20° C. for best performance, both for Gifford McMahon (GM) type cryocooler systems and pulse tube cryocooler based systems. The majority of the heat load in such systems is attributed to cooling the oil, but the oil does not need to be cooled below around 50° C. as long as the flow rate stays high, for example about 3.0 gallons per minute. Thus, there are distinct cooling requirements for each of the helium and the oil used in the cryogenic refrigeration system. This distinction has not been appreciated in traditional water-cooled or air-cooled helium compressors.

FIG. 1 shows a heat exchanger 10 having chilled water flowing therethrough, wherein cold chill water flows into an inlet in the heat exchanger 10, and circulates within an interior volume of the heat exchanger 10, before exiting as warm chill water out of an outlet of the heat exchanger 10. Hot helium is introduced through a first conduit 20 within the heat exchanger, and is cooled to yield cool helium flowing out of the first conduit 20. Similarly, hot oil is introduced through a second conduit 30 within the heat exchanger, and is cooled to yield cool oil flowing out of the second conduit 30. The hot helium and hot oil are each introduced at an end of the heat exchanger where the chill water is exiting, in theory to provide a maximum cooling gradient therebetween. Notice that each of the oil and the helium are collectively cooled by the heat exchanger, effectively cooling both the oil and the helium to some extent, but not very efficiently. Here, the oil consumes most of the cooling power of the heat exchanger, and the helium is not cooled sufficiently to yield maximum performance of the cryogenic refrigeration system.

For example, U.S. Ser. No. 12/832,438, filed Jul. 8, 2010, titled "AIR COOLED HELIUM COMPRESSOR", describes a conventional system that is embodied with a combination Helium and Oil heat exchanger unit; the contents of which are hereby incorporated by reference. Although the '438 application claims novelty of the placement of an oil cooler outdoors (as opposed to indoors) for maintaining a cool indoor environment, the embodiments described therein lend evidence of the state of the art where independent cooling requirements of the helium and oil within the system are not addressed independently, but rather, collectively.

The embodiments as described and claimed herein present an improvement over conventional architectures for helium gas compressors within such cryogenic refrigeration systems.

BRIEF DESCRIPTION OF THE DRAWINGS

In the following description, for purposes of illustration and not limitation, certain preferred embodiments are illustrated in the drawings, wherein.

DETAILED DESCRIPTION OF THE PREFERRED EMBODIMENTS

Figure 1:
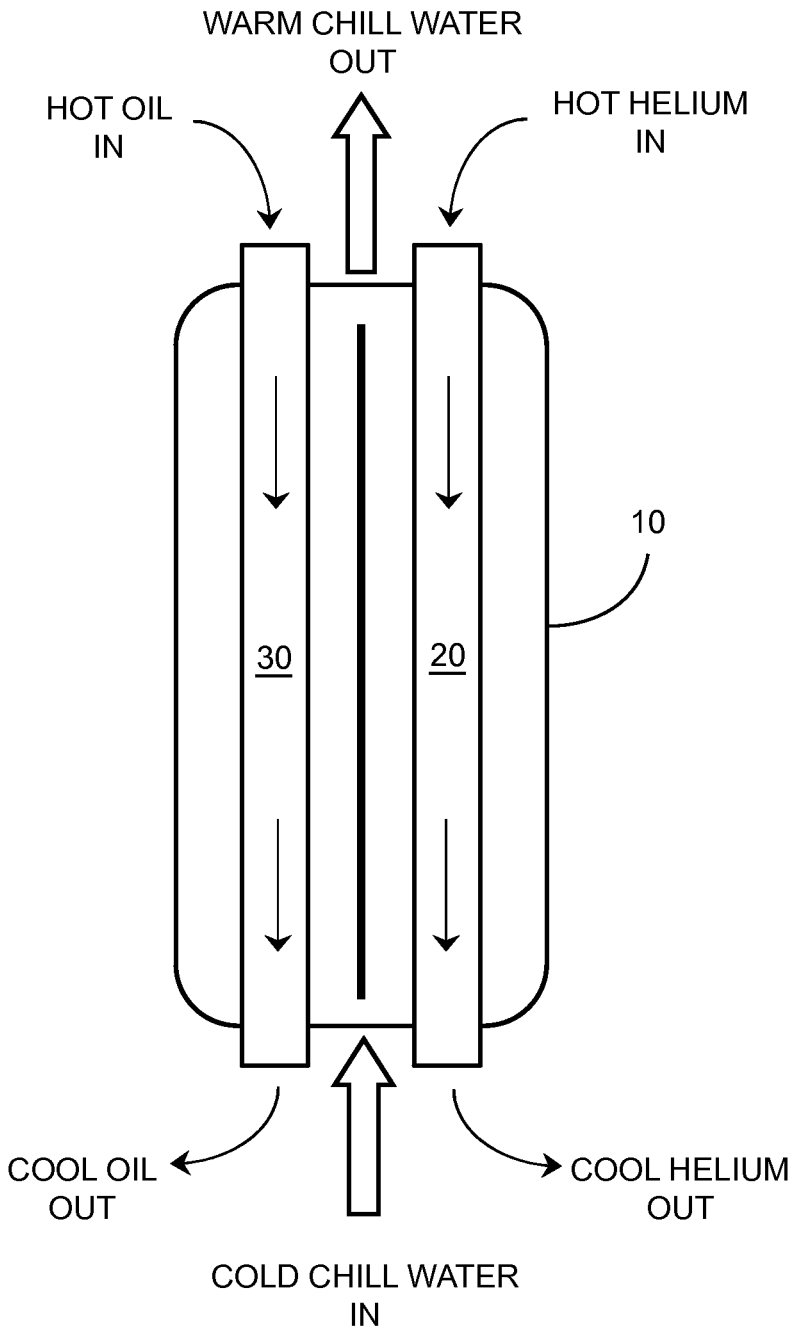
FIG.1 (PRIOR ART)
FIG. 1 shows a heat exchanger having chilled water flowing therethrough, hot helium is introduced through a first conduit within the heat exchanger, hot oil is introduced through a second conduit within the heat exchanger, each of the oil and the helium are collectively cooled by the heat exchanger, cooling both the oil and the helium but not very efficiently.
Figure 2:
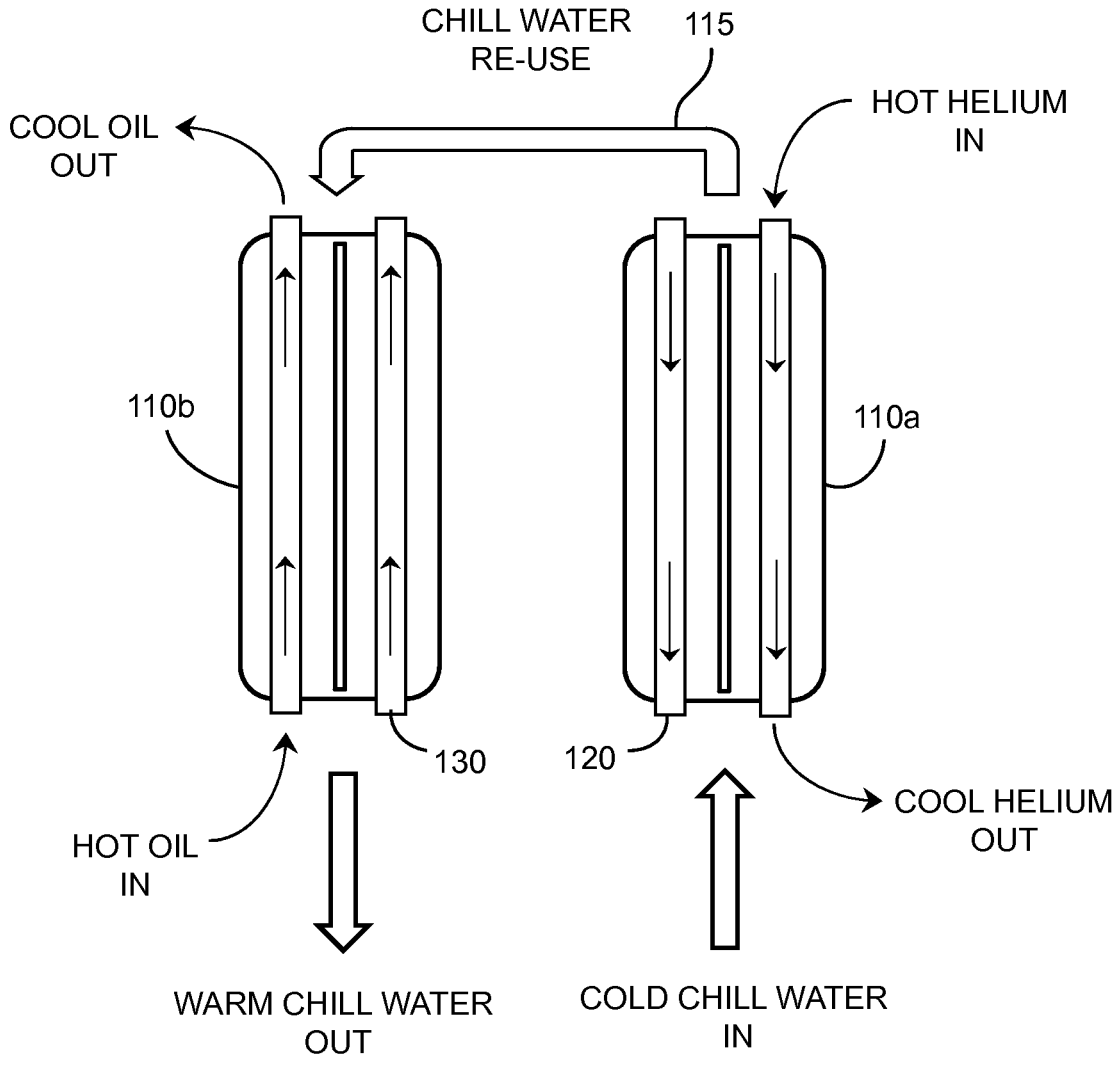
FIG. 2 shows a modular architecture for cooling helium and oil used with a helium compressor in a cryogenic refrigeration system; the modular architecture utilizes chilled water and separate heat exchangers for each of the helium and oil within the system.

FIG. 2 illustrates a modular architecture for cooling helium and oil used with a helium compressor in a cryogenic refrigeration system; the modular architecture utilizes chilled water and separate heat exchangers for each of the helium and oil within the system. This system is ideal for use with applications where chilled water is available. In this embodiment, a modular architecture provides distinct heat exchangers for each of the oil and the water used by the helium compressor. A first heat exchanger 110*a* is configured such that cold chill water flows into an inlet in the first heat exchanger, and circulates within an interior volume of the first heat exchanger, before exiting as warm chill water out of an outlet of the first heat exchanger. The first heat exchanger 110*a* is configured with one or more helium conduits 120 extending therein for communicating helium from a hot helium inlet to a cool helium outlet. Thus, as the hot helium enters through the helium conduit 120 of the first heat exchanger 110*a*, the hot helium is cooled and delivered out as cool helium through an outlet of the first heat exchanger. The warm chill water of the first heat exchanger is reused with a second heat exchanger 110*b* for cooling the oil, the second heat exchanger is connected after the first heat exchanger in series. In this regard, the helium is cooled first, and the oil is cooled second along the cycle of chilled water flowing through the modular architecture. Upon entering the second heat exchanger 110*b*, the reused chill water 115 is used to cool the oil in a manner similar to that described of the first heat exchanger. The oil is communicated through the second heat exchanger 110*b* using one or more oil conduits 130. Thus, the oil is cooled within the second heat exchanger 110*b* with reuse of the chilled water after first cooling the helium.

In the modular architecture of FIG. 2, the oil can be slightly higher in temperature than the helium, and this is acceptable because the viscosity and related flow of the oil is improved at slightly higher temperatures. Whereas, if the oil is over-cooled beyond a required temperature, the resulting flow of oil may lead to shorter life or less efficient performance of the cryogenic refrigeration system.

Figure 3:
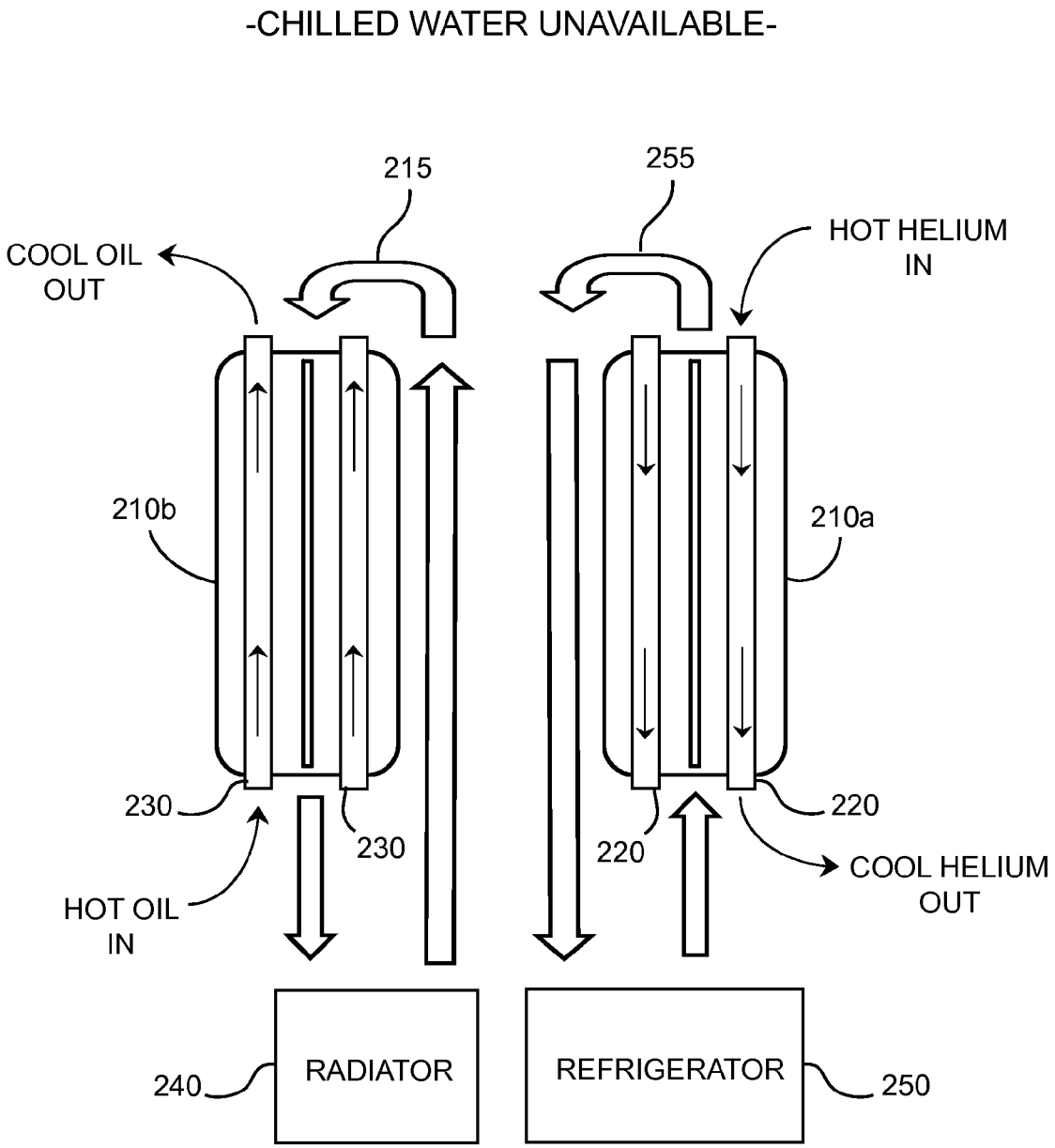
FIG. 3 shows a modular architecture for cooling helium and oil used with a helium compressor in a cryogenic refrigeration system; the modular architecture utilizes separate heat exchangers for each of the helium and oil within the system, wherein a first heat exchanger is used in closed cycle with a radiator and water for cooling the oil, and a second heat exchanger is used in closed cycle with a refrigerator and refrigerant for cooling the helium.

FIG. 3 shows a modular architecture for cooling helium and oil used with a helium compressor in a cryogenic refrigeration system; the modular architecture utilizes separate heat exchangers for each of the helium and oil within the system, wherein a first heat exchanger is used in closed cycle with a radiator and water for cooling the oil, and a second heat exchanger is used in closed cycle with a refrigerator and refrigerant for cooling the helium.

In the embodiment of FIG. 3, a first heat exchanger 210*a* is used to cool helium within the cryogenic refrigeration system. The first heat exchanger 210*a* comprises one or more helium conduits 220 configured to maximize a surface area for cooling helium gas within the first heat exchanger. Additionally, the first heat exchanger 210*a* is configured in closed-cycle fluid communication with a refrigerator 250 and a refrigerant 255 circulating therein for cooling the helium. The refrigerant can be Freon, R134, R134a, or other similar refrigerants. A refrigerator is used to condense the refrigerant, which in turn is used to cool the helium within the first heat exchanger. In this regard, the helium can be cooled to much colder temperatures here using a refrigerator and a refrigerant than in conventional systems where chilled water is utilized as the cooling means.

Furthermore, in the embodiment of FIG. 3, a second heat exchanger 210*b* is used to cool the oil within the cryogenic refrigeration system. The second heat exchanger 210*b* comprises one or more oil conduits 230 configured to maximize a surface area for cooling oil within the second heat exchanger. Additionally, the second heat exchanger 210*b* is configured in closed-cycle fluid communication with a radiator 240 and a water-based coolant circulating therein for cooling the oil. The water-based coolant 215 can be water, or a combination of water and glycol. The radiator is used to exchange heat from the water, which in turn is used to cool the oil within the second heat exchanger. In this regard, the oil can be cooled independent of the helium, and thus does limit cooling of the helium.

Figure 4:
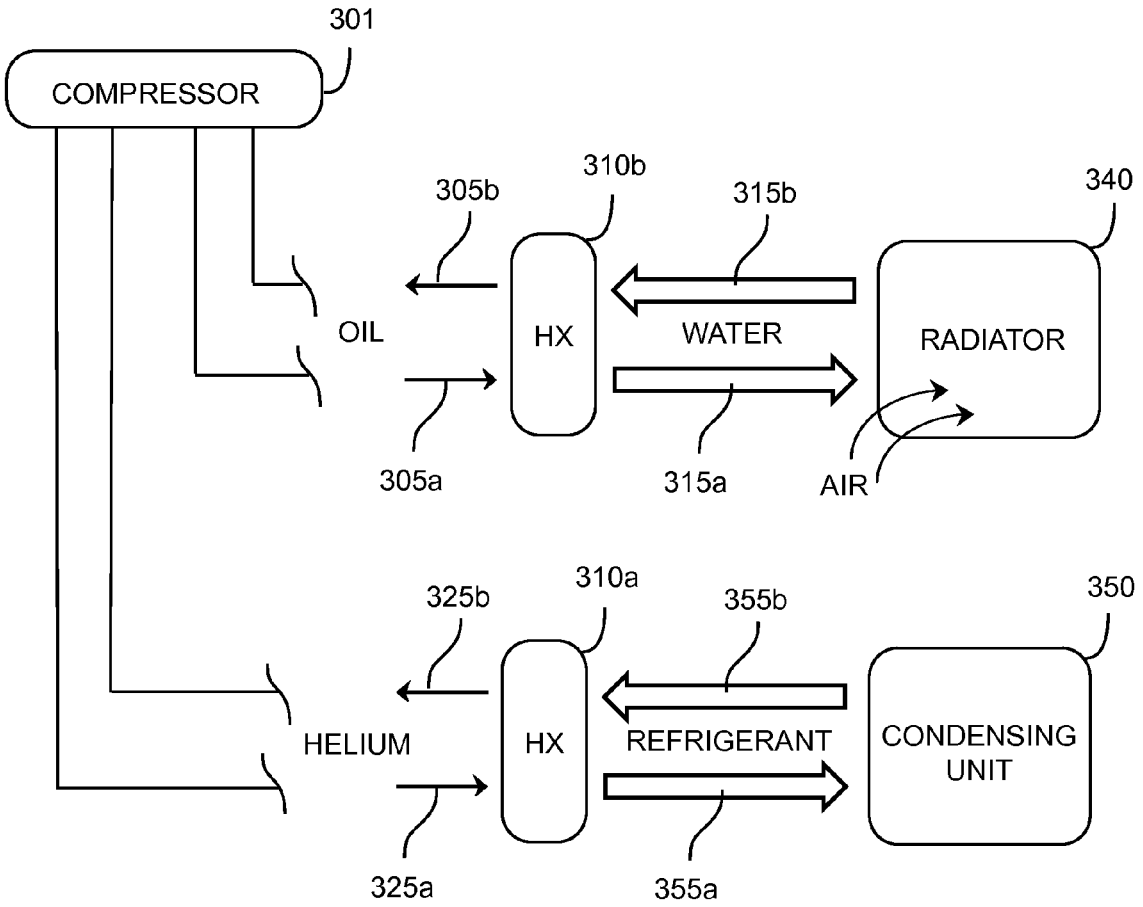
FIG. 4 shows a modular architecture for cooling helium and oil used with a helium compressor in a cryogenic refrigeration system; the modular architecture provides a compressor coupled to separate heat exchangers for each of the helium and oil within the system, wherein a first heat exchanger is used in closed cycle with a condensing unit and refrigerant for cooling the helium, and a second heat exchanger is used in closed cycle with a radiator and water for cooling the oil.

FIG. 4 shows a modular architecture for cooling helium and oil used with a helium compressor in a cryogenic refrigeration system; the modular architecture provides a compressor 301 coupled to separate heat exchangers 310*a*; 310*b* for each of the helium and oil, respectively, within the system, wherein a first heat exchanger 310*a* is used in closed cycle with a condensing unit 350 and refrigerant 355*a*; 355*b* for cooling the helium 325*a*; 325*b*, and a second heat exchanger 310*b* is used in closed cycle with a radiator 340 and water 315*a*; 315*b* for cooling the oil 305*a*; 305*b*.

Here, warm helium 325*a* leaves the compressor 301 and enters the first heat exchanger 310*a*. The first heat exchanger 310*a* comprises one or more helium conduits for circulating the helium and one of more refrigerant conduits for circulating refrigerant. As the helium is communicated through the first heat exchanger 310*a* it is cooled, and delivered back to the compressor as cool helium 325*b*. Refrigerant leaves the first heat exchanger 310*a* as a warm refrigerant 355*a*. The warm refrigerant 355*a* enters the condensing unit 350 for condensing/cooling the refrigerant. Once cooled by the condensing unit 350, cool refrigerant 355*b* is delivered back to the first heat exchanger 310*a*.

Additionally, warm oil 305*a* is delivered to the second heat exchanger 310*b* through oil conduits, cooled therein, and delivered back to the compressor 301 as cool oil. The second heat exchanger 310*b* comprises one or more oil conduits and one or more water conduits. The water leaves the second heat exchanger 310*b* as hot water 315*a*. The hot water 315*a* is introduced into the radiator 340, cooled by air, and returned as cool water 315*b* back to the heat exchanger.

In this regard, the helium and oil are independently cooled in the modular architecture as described in FIG. 4. The helium can be optimally cooled below 20° C. The oil can be independently and optimally cooled to a temperature between 45° C. and 55° C. The water flow rate can be reduced to 2.0 gallons per minute, requiring less power for use in the system.

The above examples are provided for illustrative purposes only, and are not intended to limit the spirit and scope of the invention as-claimed.

We claim:

1. An oil-lubricated compressor system which compresses a monatomic gas and which comprises: a water-cooled heat exchanger for cooling oil, wherein the water-cooled heat exchanger is coupled to a radiator for circulating cooling water therebetween in a first closed cycle; and a refrigerant-cooled heat exchanger for cooling the gas, wherein the refrigerant-cooled heat exchanger is coupled to a condensing unit configured to condense and cool a refrigerant in a second closed cycle, wherein said water-cooled heat exchanger is thermally isolated from said refrigerant-cooled heat exchanger to allow said water-cooled heat exchanger and said refrigerant-cooled heat exchanger to operate at separate temperatures.

2. The system of claim 1, wherein said refrigerant is selected from the group consisting of: Freon, R134, and R134a.

3. The system of claim 1, wherein said water comprises a mixture of water and glycol.

4. The system of claim 1, wherein the second closed cycle is independent of the first closed cycle.

5. The system of claim 1, wherein the monatomic gas and the refrigerant are cooled independently of each other.

* * * * *